US012084945B2

(12) United States Patent
Stolboushkin

(10) Patent No.: US 12,084,945 B2
(45) Date of Patent: Sep. 10, 2024

(54) FLOW CONTROL SLEEVE, METHOD AND SYSTEM

(71) Applicant: Baker Hughes Oilfield Operations LLC, Houston, TX (US)

(72) Inventor: Eugene Stolboushkin, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/153,562

(22) Filed: Jan. 12, 2023

(65) Prior Publication Data

US 2024/0240538 A1 Jul. 18, 2024

(51) Int. Cl.
*E21B 34/14* (2006.01)
*E21B 34/06* (2006.01)

(52) U.S. Cl.
CPC ..... *E21B 34/142* (2020.05); *E21B 34/063* (2013.01); *E21B 2200/06* (2020.05)

(58) Field of Classification Search
CPC ..... E21B 34/142; E21B 23/04; E21B 34/14; E21B 34/063; E21B 2200/06; E21B 33/00
See application file for complete search history.

(56) References Cited

U.S. PATENT DOCUMENTS 5,960,884 A 10/1999 Echols
8,783,365 B2 * 7/2014 McCoy ..... E21B 34/14 166/376
9,464,506 B2 * 10/2016 Coon ..... E21B 34/14
10,184,316 B2 1/2019 Flores Perez et al.
10,221,648 B2 * 3/2019 Graf ..... E21B 43/26
10,641,061 B2 * 5/2020 Bowersock ..... E21B 34/142
2011/0192613 A1 8/2011 Garcia et al.
2013/0037273 A1 2/2013 Themig et al.
2018/0347330 A1 12/2018 Facca et al.
2019/0100980 A1 4/2019 Fuxa et al.

OTHER PUBLICATIONS

Notification of Transmittal of the International Search Report and the Written Opinion of the International Searching Authority, or the Declaration; PCT/US2024/011256; mail date Apr. 30, 2024; 11 pages.

* cited by examiner

*Primary Examiner* — Catherine Loikith
(74) *Attorney, Agent, or Firm* — CANTOR COLBURN LLP

(57) ABSTRACT

A flow control configuration including a housing, and a port sleeve disposed therein having a first positively restrained position, a second positively restrained position, and a third positively restrained position within the housing. The configuration includes a first releaser associated with the first position, and a second releaser associated with the second position. A method for controlling flow including landing a first object on a seat in the port sleeve, shifting the port sleeve to the second position thereby aligning a port and an opening. The method further includes landing a second object on a second object seat within the housing and shifting the port sleeve to the third position. A borehole system includes the flow control configuration disposed within or as a part of a string in a borehole.

20 Claims, 3 Drawing Sheets

FLOW CONTROL SLEEVE, METHOD AND SYSTEM

BACKGROUND

In the resource recovery and fluid sequestration industries flow control is always important. Many configurations are known to the art but many suffer drawbacks related to seal integrity, operational complexity, and number of runs. These drawbacks are related in many cases since most configurations require movements in two directions longitudinally of the borehole, which increases chances of seal damage and requires oppositely moving components to actuate the flow control configurations. The art would appreciate alternatives that improve performance and reduce complexity.

SUMMARY

An embodiment of a flow control configuration including a housing, a port sleeve disposed within the housing and having a first positively restrained position within the housing, a second positively restrained position within the housing, and a third positively restrained position within the housing, a first releaser associated with the first positively restrained position, and a second releaser associated with the second positively restrained position.

An embodiment of a method for controlling flow including landing a first object on an object seat in the port sleeve of the configuration pressuring on the first object to shift the port sleeve from the first position to the second position, flowing a fluid through a port of the ported sleeve and an opening in the housing that is aligned with the port in the second position, and landing a second object on a second object seat within the housing and shifting the port sleeve to the third position.

An embodiment of a borehole system including a borehole in a subsurface formation, a string in the borehole, a flow control configuration disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
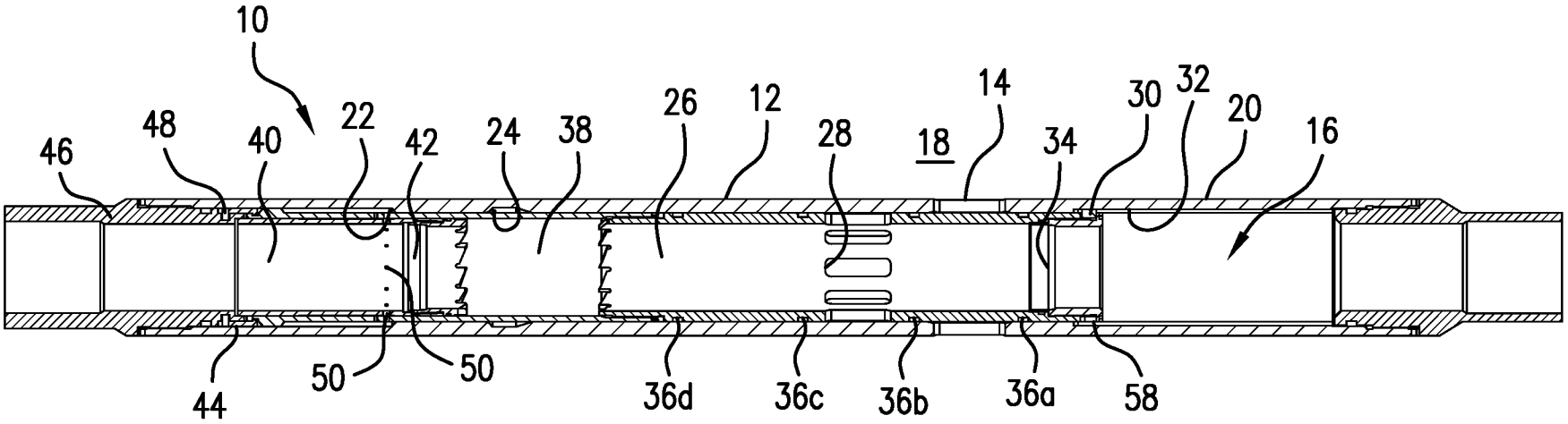
FIG. 1 is a cross sectional view of a flow control configuration as disclosed herein in a first positively restrained position.

A detailed description of one or more embodiments of the disclosed apparatus and method are presented herein by way of exemplification and not limitation with reference to the Figures.

Referring to FIGS. 1-4, a flow control configuration 10 is illustrated in a first positively restrained position, a second positively restrained position, a transition position, and a third positively restrained position, respectively. The position of FIG. 1 position is used for run-in and a first operating position, with FIGS. 2-4 being positions associated with additional operating positions of the configuration 10. In the first two positively restrained positions, releasers are employed that may be selectively released to allow movement of the configuration to the next operational position.

In one exemplary embodiment, the configuration 10 comprises a housing 12 that includes an opening 14 communicating an inside diameter volume 16 of the housing 12 with a space 18, which may be an annular space radially outwardly of an outside diameter surface 20 of the housing. The housing 12 further includes a stop profile 22 that forms a part of the configuration 10 that exhibits a second positively restrained position of the configuration 10 (illustrated in FIG. 2). The housing 12 further includes in some embodiments a lock profile 24 that forms a part of the configuration 10 that exhibits the third positively restrained position of the configuration 10 (illustrated in FIG. 4).

Disposed within the housing 12 is a port sleeve 26 having a port 28. Port sleeve 26 is slidable within housing 12 and rotationally anchored therein by a key 30 that engages the port sleeve 26 and a groove 32 in housing 12. A first object seat 34 is disposed within, attached to or as a part of the port sleeve 26. At the desired time and with an appropriately sized first object (not shown) landed on the seat 34, pressure may be applied against the object/object seat 34 to move the port sleeve 26 (along with other components discussed hereunder). Port sleeve 26 may also include a number of seals 36*a-d* thereabout that seal the port sleeve 26 to the housing 12. Seals 36*a-b* straddle the opening 14 in the first positively restrained position; seals 36*b-c* straddle the opening 14 in the second positively restrained position; and seals 36*c-d* straddle the opening 14 in the third positively restrained position.

Figure 2:
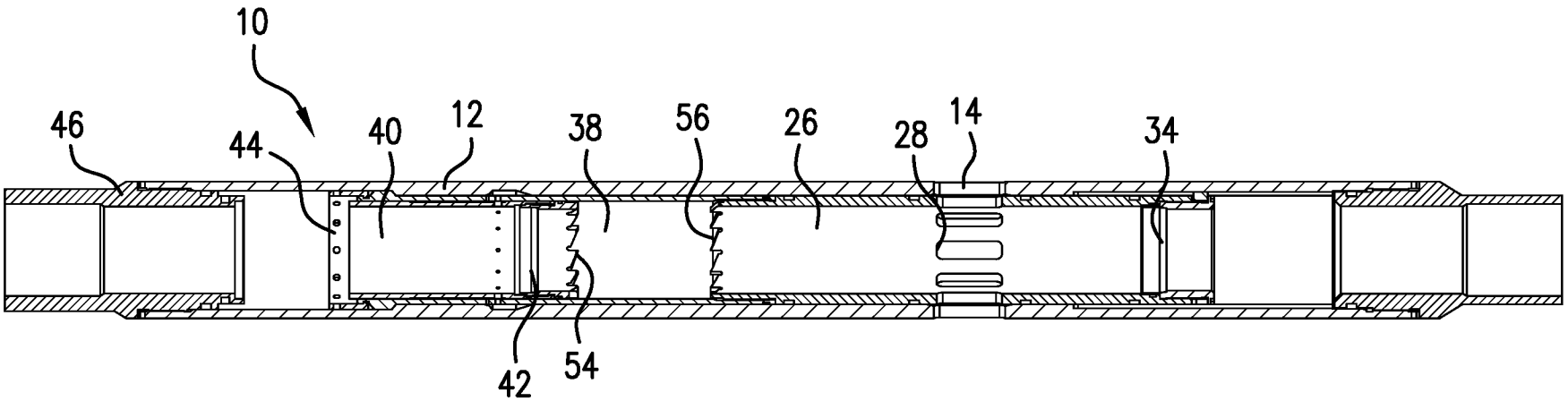
FIG. 2 is the configuration of FIG. 1 in a second positively restrained position.
Figure 3:
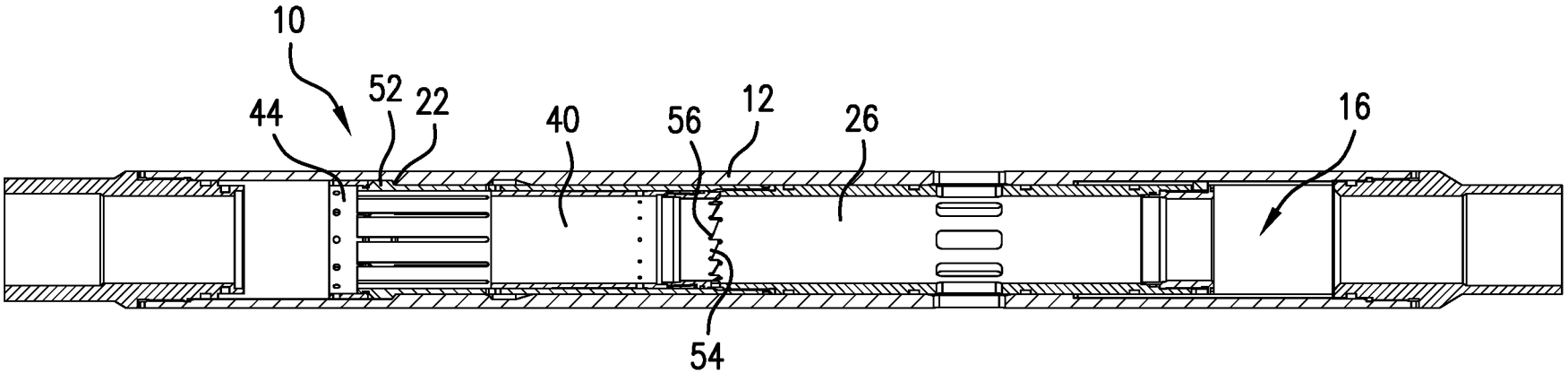
FIG. 3 is the configuration of FIG. 1 in a transition position between the second positively restrained position and a third positively restrained position.
Figure 4:
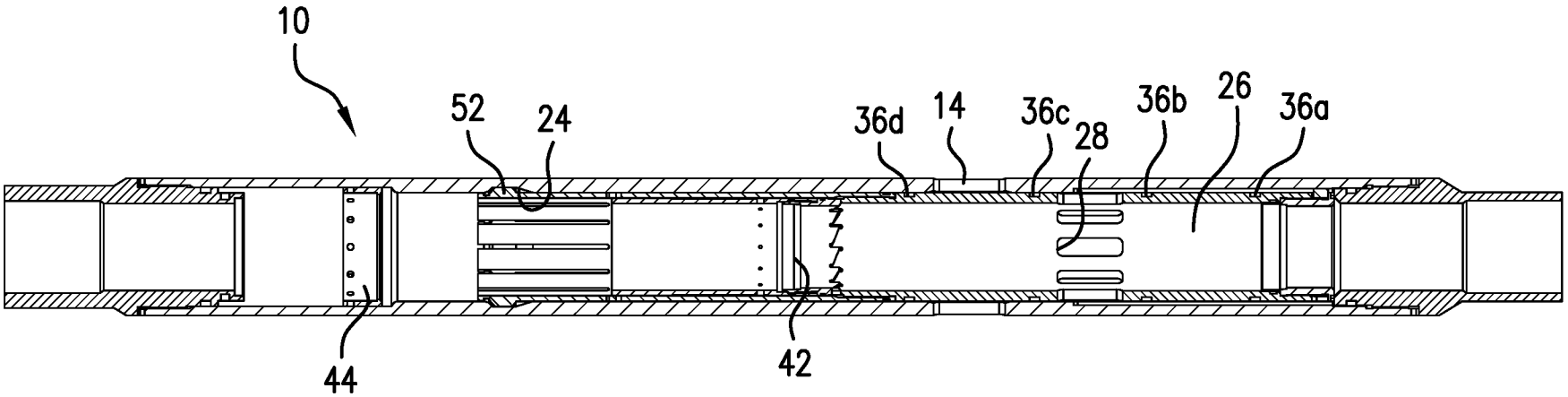
FIG. 4 is the configuration of FIG. 1 in the third positively restrained position.

Connected to the port sleeve 26 is a collet sleeve 38. Collet sleeve 38 is supported by a support sleeve 40 disposed radially inwardly of the collet sleeve 38. The support sleeve 40 is slidable within the collet sleeve 38 from a position in which the support sleeve 40 supports the collet sleeve 38 (FIGS. 1 and 2) and a position in which the support sleeve 40 is displaced from the support position leaving the collet sleeve 38 is unsupported (FIGS. 3 and 4). Movement of the support sleeve 40 is achieved via fluid pressure through a second object seat 42 (that has a larger bore than the first object seat 34) after a second object (not shown) is landed on the second object seat 42. Once the second object is landed on the second object seat 42, pressure may be applied thereto to shift the support sleeve 40. As to functionality, when the collet sleeve 38 is supported by support sleeve 40 as is illustrated in FIG. 2, sleeve 38 is only movable in the rightward direction of the drawings until the collet sleeve 38 contacts the stop profile 22. At this point fluid pressure will build against the second object/second object seat 42. When reaches a selected threshold (discussed later herein) the support sleeve 40 moves to unsupport sleeve 38 as illustrated in FIG. 3. In the position of FIG. 3, the collet sleeve 38 is deflectable such that passage beyond the stop profile 22 in a direction to the right in the figure is possible.

Returning to the first positively restrained position, a lock ring 44 is connected to the collet sleeve 38 and is also restrained to a top sub 46 by a first releaser 48, which may be for example a shear pin or similar arrangement known to the art. The first releaser 48 is the releaseable component that positively restrains the configuration 10 in the first positively restrained position.

In regard to the second positively restrained position, a second releaser 50, which may be another shear pin or similar arrangement known to the art, is an integral part of the configuration. The second releaser 50 initially secures the support sleeve 40 to the collet sleeve 38 to ensure that the collet sleeve 38 remains supported until a desired time. This ensures the second positively restrained position is held until the releaser 50 is released.

In use, the configuration 10 is run into a borehole in the position of FIG. 1 wherein the configuration 10 is positively restrained in the first position. It will be appreciated that the port 28 of the port sleeve 26 is not aligned with the opening 14 of the housing 12. Seals 36*a-b* straddle the opening 14. When it is desired to move the configuration 10 to the second positively restrained position in order to prepare the configuration for flow therethrough, such as a frac operation or similar, the first object (not shown) is landed on the first object seat 34. Fluid Pressure is applied to the configuration 10 which loads the first releaser 48. At a threshold pressure, the first releaser 48 releases allowing lock ring 44 to move away from the top sub 46 along with the port sleeve 26 collet sleeve 38 and support sleeve 40. Movement in this direction will align port 28 with opening 14. In this position (illustrated in FIG. 2) flow may move from an ID of the configuration 10 to the space 18 outside of the housing 12. Additionally, in this position, seals 36*a-b* straddle the opening 14 and the port 28. A flow operation such as a fracture operation can be conducted at this point since the first object is on the first object seat 34 and pressure/flow applied will cause fluid to flow through the aligned ports 28 and openings 14. The port sleeve 26 cannot move from this position because a collet finger 52 of the collet sleeve 38 has engaged the stop profile 22 of the housing 12. In this position (again FIG. 2), movement of the collet sleeve 38 and port sleeve 26 to the right of the housing 12 (in the Figures) is not possible. This is because the support sleeve 40 is in a position where the collet sleeve 38 is supported and the collet finger 52 may not deflect to release the stop profile 22. Accordingly, the configuration 10 is stable in this condition even in the face of high flow rates or high flowing fluid pressures. After completion of the flow control operation, and when it is desired to close the port sleeve 26, the second object (larger than the first object) (not shown) is landed on the second object seat 42. With second object seat 42 occluded by the second object, pressure may be applied to the second object seat 42 thereby loading second releaser 50. Upon release of the second releaser 50 at a selected threshold pressure, the support sleeve 40 becomes movable relative to the collet sleeve 38 and upon such movement will unsupport collet finger 52. Because of the movement of the support sleeve 40, the physical volume the pressurized fluid occupies enlarges a small amount which will inevitably reduce the pressure by a small margin. Because the pressurized volume is essentially the entire string, the reduction in pressure is quite small. Nevertheless, the pressure will again be raised to shift the collet sleeve 38. In an embodiment, the pressure to release the second releaser 50 is about 3000 pounds per square inch (PSI) and the pressure to move the collet sleeve 38 is also about 3000 PSI. Hence the small change in pressure from the movement of the support sleeve 40 does mean that pressure must again be raised such that two pressure events are in fact used in the shifting of the configuration 10 from the second to the third position. As a practical matter however, the releasing of releaser 50 and the deflection of the collet sleeve 38 happen so fast that only a single change in pressure would be noticeable at a surface gauge even though two very small changes occur and could be sensed with a high speed transducer locally positioned to the configuration 10. Once the collet sleeve 38 is unsupported the pressure applied is sufficient to cause collet finger 52 to deflect from and release stop profile 22. Support sleeve 40 is shown in the collet-sleeve-unsupported position in FIG. 3. It is also appreciable in FIG. 3 how the collet finger 52 may deflect out of engagement with stop profile 22. Once the collet finger 52 releases stop profile 22 the collet sleeve 38 and port sleeve 40 will move within the housing 12. This movement will cause the ports 28 to misalign with openings 14 and for seals 36*c* and 36*d* to straddle the opening 14 sealing the same. In some embodiments, the configuration 10 may simply be left in this condition, however, in other embodiments where it is desired to ensure that configuration 10 cannot reopen, the movement just described will continue until fingers 52 engage lock profile 24. This will permanently close configuration 10.

While the collet sleeve 38 is specifically illustrated, it is to be appreciated that other arrangements may be substituted to achieve the same results as the collet sleeve 38 does in the configuration 10. For example, the collet sleeve 38 may be substituted by a blank sleeve that has openings therein to receive a set of dogs, the dogs being supported by the support sleeve 40 in the first position engaging a recess in the housing and supported in that position by the support sleeve 40. The dogs would land on stop profile 22 in the same way as the above description and at the same time in the sequence. Then upon movement of the support sleeve 40, again in the same way as previously described, the dogs would drop radially inwardly and the sleeve that was the collet sleeve 38 in the previous embodiment would be free to move to the third position. It is noted that in this embodiment, there would be no additional pressure up with moving from the second to third positions as discussed above. Essentially, a radially moveable or deformable element (e.g., dog, or deformable finger of the collet sleeve 38, for example) that, in the supported position, is able to withstand the hydraulic load during pumping in the second position is contemplated followed by the second release that allows movement of the configuration 10 to the third position. It will be understood by those of ordinary skill in the art that such an element could be a collet, dogs, an extrudable ring, and other elements capable of the same function and commonly known in the field.

In embodiments, it is sometimes desirable to provide an engagement feature 54 on the second object seat 42 and a complimentary engagement feature 56 on the port sleeve 26 so that upon contact between engagement feature 54 and engagement feature 56, the support sleeve 40 and second object seat 42 may not rotate relative to port sleeve 26. This is helpful during drill out operations. Because of the key 30 and groove 32 discussed above, the port sleeve 26 is also non rotatable relative to housing 12. With the engagement features 54 and 56, none of these components can spin relative to housing 12 during drill out.

It is also to be noted that degradable objects are contemplated for configuration 10. If degradable objects are employed, it would not be necessary to drill out components of configuration 10 but merely to allow the objects to degrade in a selected period of time. In order to enhance degradation of the first object on the first object seat 34 it is noted that the first object seat 34 includes surface features 58 that along with groove 32 produce, a flow passage that allows degratory fluids to more effectively circulate about the first object.

It is to be appreciated that the configuration 10 provides a true three-position single-direction operation. That is, the configuration is initially closed and retained in that position. Then configuration 10 is opened by moving in a first direction and retained in that second position. Finally, configuration 10 is reclosed by continued moving in the first direction. Importantly, each of these positions is obtained with movement only in a single direction. Moreover, the movement requires only application of pressure and no intervention of any other kind. In addition, a significant benefit of the configuration 10 is that a sand plug (not shown but familiar to those of ordinary skill in the art) which is a common occurrence in fracturing operations, and which tends to complicate closing operations, becomes a non issue in configuration 10 because the plug itself simply moves with the port sleeve 26. One of ordinary skill in the art understands that a sand plug would occur from just upstream of the first object to the downstream edge of the port 28. With this in mind, it will be clear to the same person of ordinary skill in the art that the sand plug will not interfere with the closing operation or damage any of seals 36*a* through 36*d* during the closing operation of configuration 10.

Figure 5:
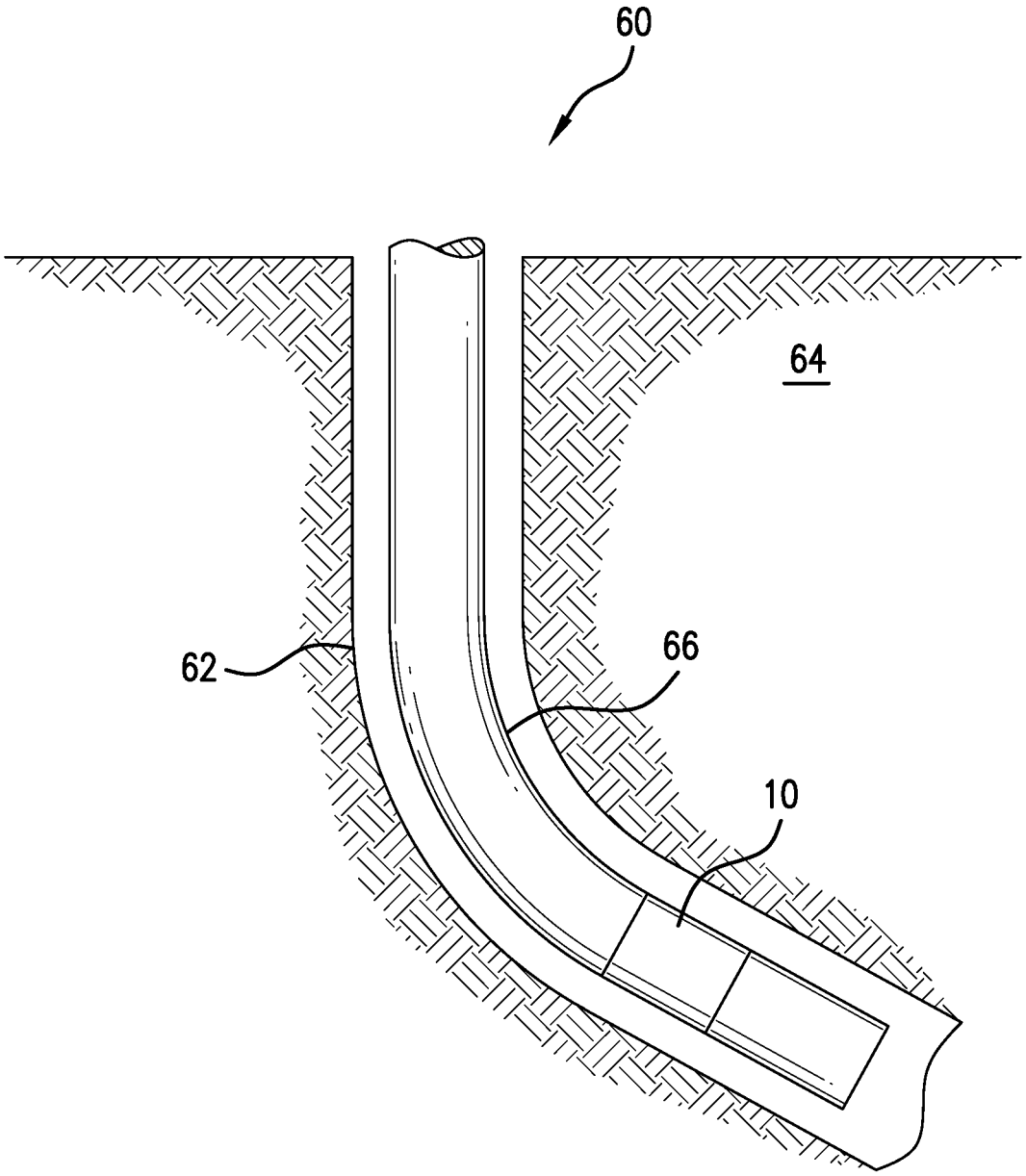
FIG. 5 is a view of a borehole system including flow control configuration as disclosed herein.

Referring to FIG. 5, a borehole system 60 is illustrated. The system 60 comprises a borehole 62 in a subsurface formation 64. A string 66 is disposed within the borehole 62. A configuration 10 as disclosed herein is disposed within or as a part of the string 66.

Set forth below are some embodiments of the foregoing disclosure:

Embodiment 1: A flow control configuration including a housing, a port sleeve disposed within the housing and having a first positively restrained position within the housing, a second positively restrained position within the housing, and a third positively restrained position within the housing, a first releaser associated with the first positively restrained position, and a second releaser associated with the second positively restrained position.

Embodiment 2: The configuration as in any prior embodiment, wherein the port sleeve in the second position aligns a port of the port sleeve with an opening in the housing.

Embodiment 3: The configuration as in any prior embodiment, wherein the first, second, and third positions are achieved seriatim in a single direction of movement.

Embodiment 4: The configuration as in any prior embodiment, wherein the housing includes an alignment groove.

Embodiment 5: The configuration as in any prior embodiment, wherein the port sleeve is slidably engaged with the alignment groove.

Embodiment 6: The configuration as in any prior embodiment, wherein the first releaser is a shear configuration.

Embodiment 7: The configuration as in any prior embodiment, wherein the second releaser comprises a radially movable or deformable element.

Embodiment 8: The configuration as in any prior embodiment, wherein the element is a portion of a collet sleeve.

Embodiment 9: The configuration as in any prior embodiment, wherein the port sleeve includes an object seat.

Embodiment 10: The configuration as in any prior embodiment, wherein the seat includes outside diameter flow channels aligned with an alignment groove in the housing.

Embodiment 11: The configuration as in any prior embodiment, further including a collet sleeve disposed in the housing and a support sleeve disposed radially within the collet sleeve.

Embodiment 12: The configuration as in any prior embodiment, wherein the housing includes a profile therein.

Embodiment 13: The configuration as in any prior embodiment, wherein the profile presents two stop shoulders that provide the positive restraint in the second and third positions of the port sleeve.

Embodiment 14: A method for controlling flow including landing a first object on an object seat in the port sleeve of the configuration of any prior embodiment, pressuring on the first object to shift the port sleeve from the first position to the second position, flowing a fluid through a port of the ported sleeve and an opening in the housing that is aligned with the port in the second position, and landing a second object on a second object seat within the housing and shifting the port sleeve to the third position.

Embodiment 15: The method as in any prior embodiment, wherein the pressuring on the first object releases the first releaser.

Embodiment 16: The method as in any prior embodiment, wherein the pressuring on the second object releases the second releaser.

Embodiment 17: The method as in any prior embodiment, further comprising shifting a support sleeve from a position supporting a collet sleeve to a position unsupporting the collet sleeve and deflecting the collet sleeve to release the second position.

Embodiment 18: The method as in any prior embodiment, further including flowing a fluid around the first object seat through an alignment groove in the housing and degrading the first object.

Embodiment 19: The method as in any prior embodiment, wherein the shifting of the port sleeve is in a single direction from the first position to the second position to the third position.

Embodiment 20: A borehole system including a borehole in a subsurface formation, a string in the borehole, a flow control configuration as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A flow control configuration comprising:

a housing having an opening;

a port sleeve disposed within the housing and having, in order, a first positively restrained and closed position within the housing, wherein the port of the housing is closed to flow by the port sleeve, a second positively restrained and open position within the housing wherein the port of the housing is open to flow, and a third positively restrained and closed position within the housing, wherein the port of the housing is closed to flow by the port sleeve.

2. The configuration as claimed in claim 1, wherein the port sleeve with the opening in the housing.

3. The configuration as claimed in claim 1, wherein the first, second, and third positions are achieved seriatim in a single direction of movement.

4. The configuration as claimed in claim 1, wherein the housing includes an alignment groove.

5. The configuration as claimed in claim 4, wherein the port sleeve is slidably engaged with the alignment groove.

6. The configuration as claimed in claim 1, wherein the first releaser is a shear configuration.

7. The configuration as claimed in claim 1, wherein the second releaser comprises a radially movable or deformable element.

8. The configuration as claimed in claim 7, wherein the element is a portion of a collet sleeve.

9. The configuration as claimed in claim 1, wherein the port sleeve includes an object seat.

10. The configuration as claimed in claim 9, wherein the seat includes outside diameter flow channels aligned with an alignment groove in the housing.

11. The configuration as claimed in claim 1, further including a collet sleeve disposed in the housing and a support sleeve disposed radially within the collet sleeve.

12. The configuration as claimed in claim 1, wherein the housing includes a profile therein.

13. The configuration as claimed in claim 12, wherein the profile presents two stop shoulders that provide the positive restraint in the second and third positions of the port sleeve.

14. A method for controlling flow comprising:

landing a first object on an object seat in the port sleeve of the configuration of claim 1;

pressuring on the first object to shift the port sleeve from the first position to the second position;

flowing a fluid through a port of the ported sleeve and the opening in the housing that is aligned with the port in the second position; and landing a second object on a second object seat within the housing and shifting the port sleeve to the third position.

15. The method as claimed in claim 14, wherein the pressuring on the first object releases the first releaser.

16. The method as claimed in claim 14, wherein the pressuring on the second object releases the second releaser.

17. The method as claimed in claim 16, further comprising shifting a support sleeve from a position supporting a collet sleeve to a position unsupporting the collet sleeve and deflecting the collet sleeve to release the second position.

18. The method as claimed in claim 14, further including flowing a fluid around the first object seat through an alignment groove in the housing and degrading the first object.

19. The method as claimed in claim 14, wherein the shifting of the port sleeve is in a single direction from the first position to the second position to the third position.

20. A borehole system comprising:

a borehole in a subsurface formation;

a string in the borehole; and a flow control configuration as claimed in claim 1 disposed within or as a part of the string.

* * * * *